US007946900B2

(12) United States Patent
Chang et al.

(10) Patent No.: US 7,946,900 B2
(45) Date of Patent: May 24, 2011

(54) FABRICATION METHOD OF DISCHARGE LAMP

(75) Inventors: Tjong-Ren Chang, Hsinchu (TW); Jin-Yuh Lu, Taipei (TW); Wei-Yuan Tsou, Daxi Town (TW); Chun-Chieh Huang, Hsinchu (TW); Chun-Hsu Lin, Taichung (TW); Chin-Chia Chang, Keelung (TW)

(73) Assignee: Wellypower Optronics Corporation, Hsin-Chu (TW)

( * ) Notice: Subject to any disclaimer, the term of this patent is extended or adjusted under 35 U.S.C. 154(b) by 256 days.

(21) Appl. No.: 12/468,204

(22) Filed: May 19, 2009

(65) Prior Publication Data

US 2010/0029166 A1 Feb. 4, 2010

(30) Foreign Application Priority Data

Jul. 31, 2008 (TW) ..... 97128985 A

(51) Int. Cl.
*H01J 9/26* (2006.01)
*H01J 9/24* (2006.01)

(52) U.S. Cl. ..... 445/26; 445/22

(58) Field of Classification Search ..... 445/22, 445/23, 26, 27

See application file for complete search history.

(56) References Cited

FOREIGN PATENT DOCUMENTS

| | | | |
|---|---|---|---|
| CN | 1801455 A | * | 7/2006 |
| JP | 53112450 A | * | 9/1978 |
| JP | 03225744 A | * | 10/1991 |

* cited by examiner

*Primary Examiner* — Mariceli Santiago
(74) *Attorney, Agent, or Firm* — Snell & Wilmer L.L.P.

(57) ABSTRACT

A fabrication method for discharge lamps is disclosed, which comprises providing a glass tube of diameter between 2 and 20 mm, the glass tube having an inner wall coated with a fluorescent phosphor and having a through-passage with a first end and a second end, connecting a first dielectric electrode to the first end of the glass tube by applying an adhesive to a contacted portion of the glass tube and the first dielectric electrode, and sintering the contacted portion of the glass tube and the first dielectric electrode to securely connect the glass tube and the first dielectric electrode. Subsequently, processes of filling and sealing are conducted to complete the fabrication of the discharge lamps.

20 Claims, 5 Drawing Sheets

FABRICATION METHOD OF DISCHARGE LAMP

CROSS-REFERENCE TO RELATED APPLICATIONS

This application claims priority to Taiwan Patent Application No. 97128985 entitled "FABRICATION METHOD OF DISCHARGE LAMP," filed on Jul. 31, 2008, which is incorporated herein by reference and assigned to the assignee herein.

FIELD OF INVENTION

The present invention generally relates to a fabrication method for discharge lamps, and more particularly, for discharge lamps with dielectric electrodes.

BACKGROUND OF THE INVENTION

FIG. 1 shows a prior art cold cathode fluorescent lamp (CCFL) 10, which includes a glass tube 102 with the inner wall thereof coated with fluorescent phosphor 100, conducting wire 104, a pair of electrodes 106, induction gas 108, and mercury atoms 110. The electrodes 106 are sealed on both sides inside of the CCFL 10, and the ends of the electrodes 106 are respectively coupled to a conduction wire 104 extending outside of the lamp for connecting with power supply wire, so as to conduct electrical current, thereby causing the lamp to illuminate.

Typically, the wire 104 of the CCFL 10 and the power supply wire are connected with one another by soldering or being wrapped together in strip copper. Nevertheless, connection means of either soldering or strip copper wrapping requires intensive and complex processing steps, and thus problems caused by poor processing often occur. For example, if soldering is adapted, cold solder resulted from poor soldering can cause the high temperature generated during lamp illumination to burn out the tin solder at the junction of the connecting wires, creating an open circuit. On the other hand, if strip copper wrapping is adapted, potential point discharge at the sharp-angled spots of the strip copper can occur.

On other hand, in backlight module applications, each frequency converter, such as an inverter for example, is only capable of driving one to two CCFLs. As the size of display becomes larger, the number of lamps used increases, such that more frequency converters are required to drive the increased lamps. However, increasing the number of frequency converters will inevitably raise the overall power consumption as well as the temperature.

Therefore, there is a need to provide a discharge lamp that has a low fraction of defects, requires low energy and produces low pollution.

SUMMARY OF THE INVENTION

In view of the disadvantages of the prior art, the present invention provides a fabrication method of discharge lamps, using external dielectric electrodes to achieve long lifetime, low trigger voltage and high luminance, and reducing the number of frequency converters used. In addition, by the present invention, filling of mercury in lamps can be selectively excluded.

In accordance with an aspect of the present invention, a fabrication method for discharge lamps is disclosed, which comprises providing a glass tube of diameter between 2 and 20 mm, the glass tube having an inner wall coated with a fluorescent phosphor and having a through-passage with a first end and a second end, connecting a first dielectric electrode to the first end of the glass tube by applying an adhesive to a contacted portion of the glass tube and the first dielectric electrode, and sintering the contacted portion of the glass tube and the first dielectric electrode to securely connect the glass tube with the first dielectric electrode. Subsequently, processes of filling and sealing are conducted to complete the fabrication of the discharge lamp.

In another aspect of the present invention, there are provided a first glass tube with fluorescent phosphor on the inner wall thereof, a hollow-shaped first dielectric electrode, a second dielectric electrode and a second glass tube, wherein the above components are securely connected with one another, such that the first dielectric electrode is located between the first glass tube and the second glass tube, and the second dielectric electrode is securely connected to the end of the first glass tube not connected to the first dielectric electrode.

In accordance with still another aspect of the present invention, there are provided a first glass tube with fluorescent phosphor on the inner wall thereof, a pair of hollow-shaped first and second dielectric electrodes, and a pair of second and third glass tubes, wherein the above components are connected with one another, such that the first dielectric electrode is located between the first glass tube and the second glass tube, and the second dielectric electrode is located between the first glass tube and the third glass tube.

In accordance with still another aspect of the present invention, there are provided a first glass tube with fluorescent phosphor on the inner wall thereof, a ring-shaped first dielectric electrode, a cup-shaped second dielectric electrode and a second glass tube, wherein the above components are securely connected with one another, such that the first dielectric electrode is located between the first glass tube and the second glass tube, and the second dielectric electrode is securely connected to the end of the first glass tube not connected to the first dielectric electrode by means of sealing.

After the above steps are accomplished, sintering, filling, and sealing processes are conducted to complete the fabrication of discharge lamps.

Discharge lamps produced according to the fabrication method of the present invention, compared to the prior art CCFLs and external electrode fluorescent lamps (EEFL), possess the advantages of longer lifetime, lower trigger voltage, and larger conduction current. Besides, in an embodiment of the present invention, xenon is disclosed as an alternative to mercury in the discharge lamps, thereby reducing environmental pollution.

The objectives, embodiments, features, and advantages of the invention will be apparent from the following more particular description of preferred embodiments and drawings of the invention.

DETAILED DESCRIPTION OF THE INVENTION

During operation of traditional discharge lamps, mercury vapor can be reacted with metal electrodes to form mercury-containing amalgams, as a result of which the amount of mercury available for the discharge operation is decreased, and the lifetime of the traditional discharge lamps is adversely affected. Since such problems do not occur in discharge lamps with dielectric electrodes, the dielectric electrode discharge lamps generally have a longer lifetime (e.g., about 30,000 hours) than the traditional discharge lamps.

The dielectric electrode discharge lamps of the present invention generally have a tube outer diameter between 2 and 20 mm, and preferably between 3 and 10 mm. Compared to conventional hot cathode fluorescent lamps (HCFLs), the dielectric electrode discharge lamps may have a smaller tube diameter and thus are applicable to general lighting installations and to thin backlight modules (such as for monitors or televisions) as well. In addition, compared to cold cathode fluorescent lamps (CCFLs), since the dielectric electrode discharge lamps are external electrode discharge lamps and the dielectric electrodes are high-voltage resistant, the dielectric electrode discharge lamps may have a tube outer diameter larger than 10 mm and can be used to produce high-power (e.g., larger than 20 W) lamps/bulbs that are specifically required in certain circumstances and products (e.g., large-size backlight modules).

Figure 1:
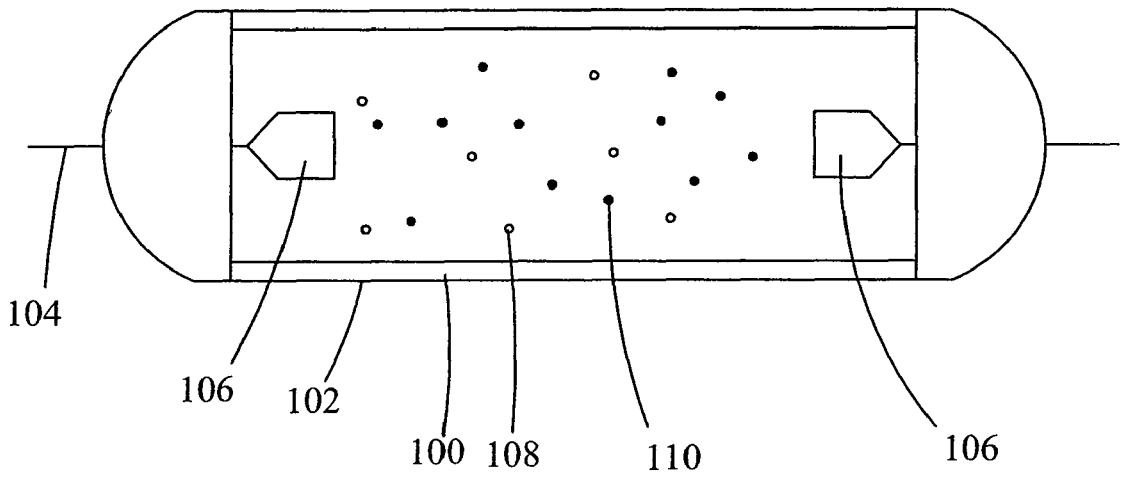
FIG. 1(Prior Art)
FIG. 1 is a schematic diagram of a prior art discharge lamp.
Figure 2:
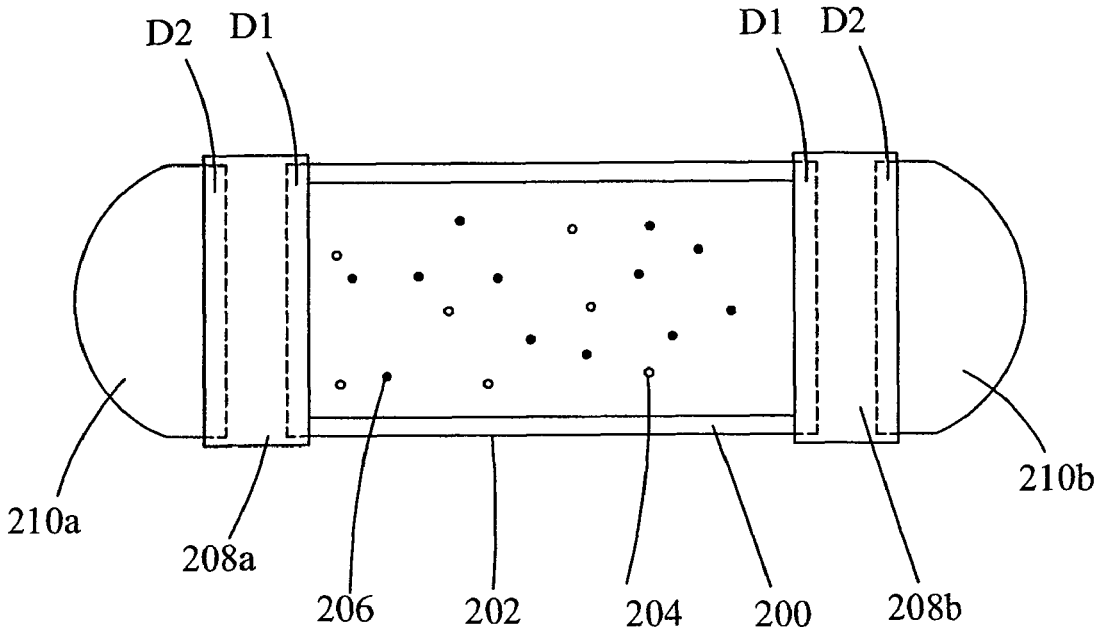
FIG. 2 is a schematic diagram of a discharge lamp according to an embodiment of the present invention.

FIG. 2 shows a discharge lamp produced according to an embodiment of the fabrication method of the present invention. A discharge lamp 20 includes a glass tube 202 with fluorescent phosphor 200 on the inner wall thereof, inert gas atoms 204, mercury atoms 206, a pair of hollow ring-shaped dielectric electrodes 208*a* and 208*b*, and two glass tubes 210*a* and 210*b*. The dielectric electrodes 208*a* and 208*b* are connected to an external power supply, and the outer surfaces of the dielectric electrodes 208*a* and 208*b* may be coated with a metal conductive layer such that when conducted, the dielectric electrodes 208*a* and 208*b* experience capacitive effect causing the electrons and holes (both not shown) within the glass tube 202 to aggregate at the positive and negative sides of the dielectric electrodes 208*a* and 208*b*, and to be subject to transmission to the opposite ends, namely dielectric electrodes 208*b* and 208*a*, of the glass tube 202. In this embodiment, the electrodes 208*a* and 208*b* may be formed of a ceramic material which has a dielectric constant of about 10 or above. For example, the dielectric electrodes 208*a* and 208*b* may comprise CaO, $TiO_2$, SrO, $ZrO_2$, MgO, or the combination thereof. In a preferred embodiment, the electrodes 208*a* and 208*b* further comprise one or more materials selected from a group consisting of MnO, $Al_2O_3$, $Fe_2O_3$ and $Cr_2O_3$. In other embodiments, the glass frits such as $K_2O$, $Na_2O$, $B_2O_3$, $SiO_2$ or $Al_2O_3$ or the combination thereof also can be added to the dielectric electrodes 208*a* and 208*b* to adjust the thermal expansion coefficient. Moreover, the outer surfaces of the dielectric electrodes 208*a* and 208*b* may be coated with a high conductive material such as carbon, silver or tin for increasing the conductivity thereof.

From the above description, after high voltage is inputted to the dielectric electrodes 208*a* and 208*b*, gas discharge phenomenon occurs in the discharge lamp 20. After being transmitted from the cathode, the electrons accumulate a considerable amount of kinetic energy through a series of energy transfer (from collisions with the inert gas atoms 204 for example), and finally collide with the low-pressure mercury atoms 206 where the free electrons transfer their kinetic energy to the mercury atoms 206, causing the mercury atoms 206 to be excited to an excited state and immediately back to the steady state. As the mercury atoms 206 return to the steady state, the energy absorbed will be released in the form of ultraviolet light (wavelength of 253.7 nm) which will then be absorbed by the fluorescent phosphor 200 to be further converted to visible light of correlated color temperature for emission. The free electrons are continuously accelerated by the external power supply generated electric field as the above process repeats in the lamp.

Figure 3:
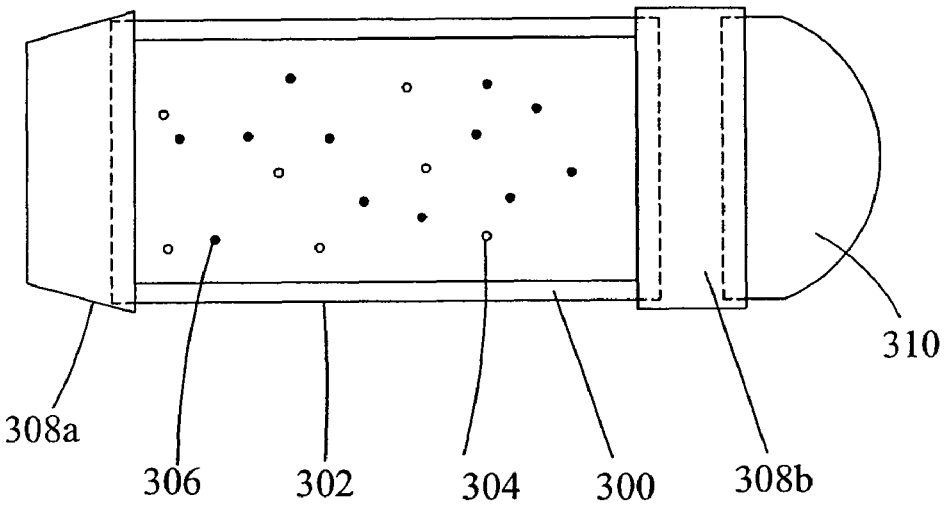
FIG. 3 is a schematic diagram of a discharge lamp according to another embodiment of the present invention.

FIG. 3 shows a discharge lamp produced according to another embodiment of the fabrication method of the present invention. The discharge lamp 30 is substantially the same as the discharge lamp 20 of FIG. 2, with the only difference being that in the discharge lamp 30, the dielectric electrode 308*a* is cup-shaped with an opening on one end thereof, and thus the dielectric electrode 308*a* is not connected to the glass tube 302 in the manner its counterpart dielectric electrode 208*a* is connected to the glass tube 210*a*, but is directly connected thereto by sealing.

Figure 4:
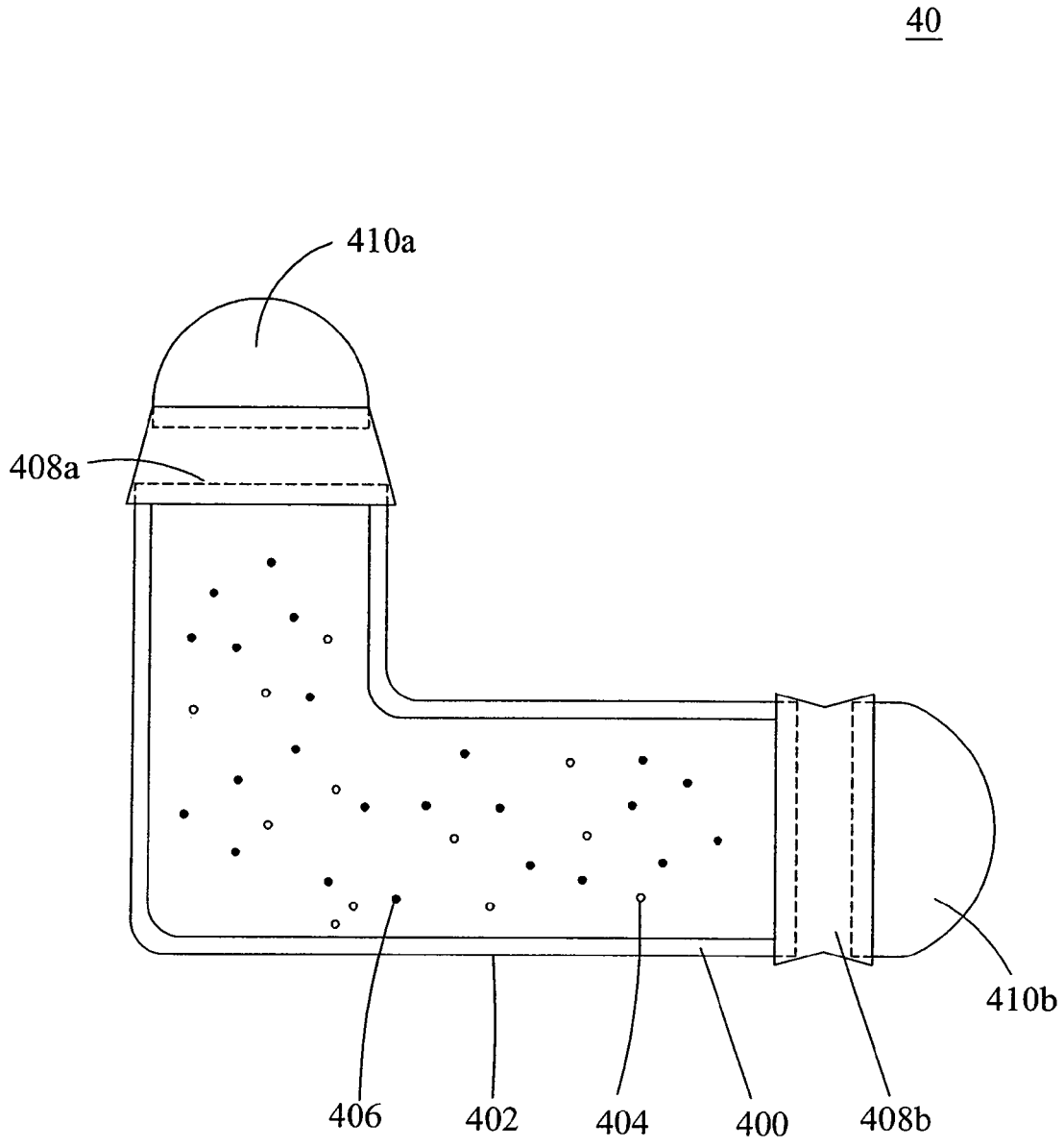
FIG. 4 is a schematic diagram of a discharge lamp according to still another embodiment of the present invention.

FIG. 4 shows a discharge lamp produced according to still another embodiment of the fabrication method of the present invention. Similar to FIG. 3, the discharge lamp 40 is substantially the same as the discharge lamp 20 of FIG. 2, with the only difference being that the glass tube 402 of the discharge lamp 40 has a L-shape curvature, and the dielectric electrode 408*a* is a trapezoid with one end having a smaller diameter and the dielectric electrode 408*b* is hollow ring-shaped with a midsection having a smaller diameter, as compared to that of the counterpart straight-line glass tube 202 and the uniform, hollow ring-shaped dielectric electrodes 208*a* and 208*b*.

Those skilled in the art should understand that the above embodiments are intended to be exemplary and not an exhaustive list containing all possible embodiments. The shape of the glass tubes and dielectric electrodes can vary depending on the manufacture process adopted and targeted application.

The discharge lamp of the present invention utilizes ceramic as the electrode material, and therefore, compared to the prior art CCFLs and EEFLs, has advantages of having lower trigger voltage, larger conduction current and longer lifetime. Furthermore, only one frequency converter (such as an inverter) is required to drive multiple dielectric electrode lamps, thereby decreasing the quantity of the frequency inverters to reduce costs and simplify the backlight module design.

Figure 5:
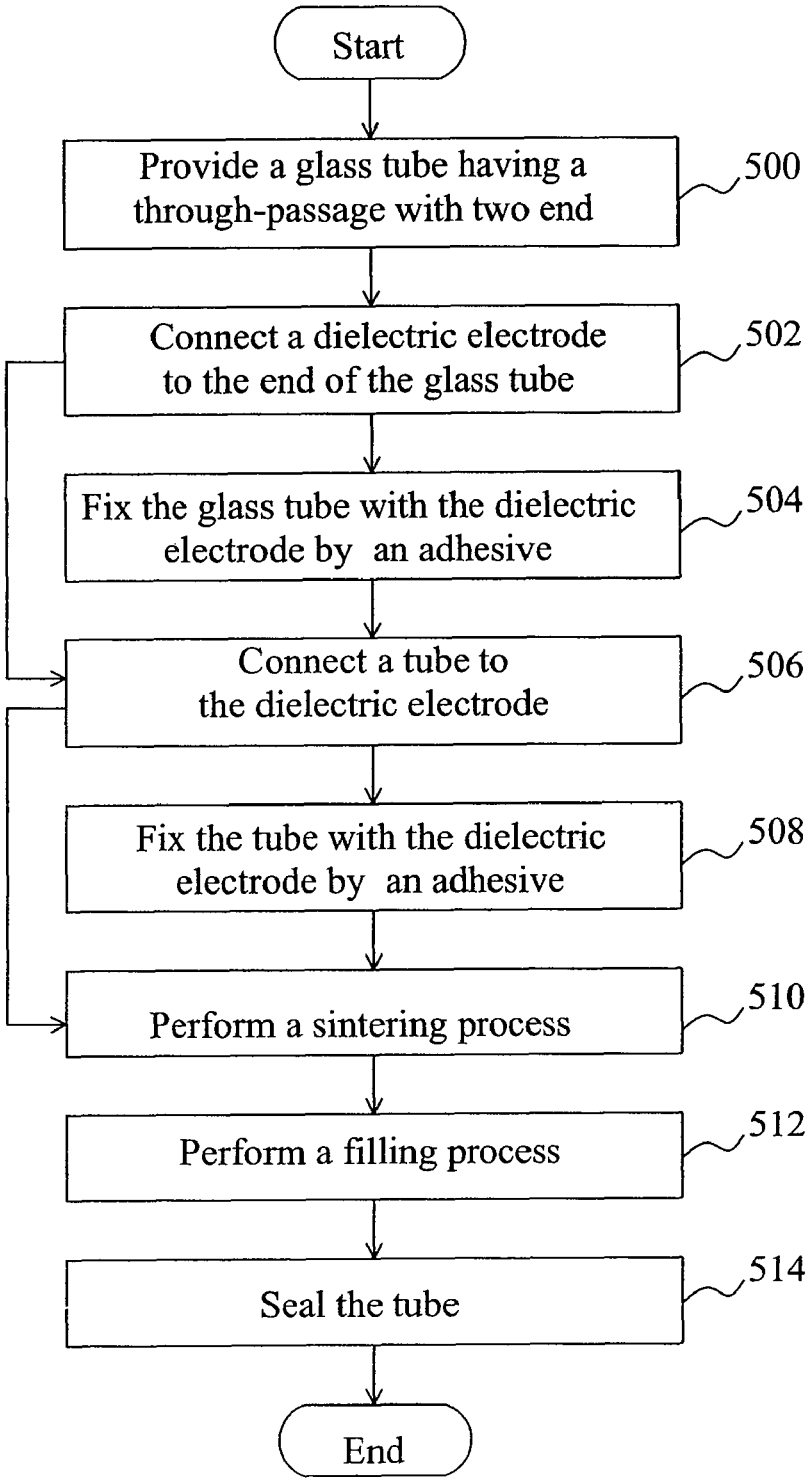
FIG. 5 is a flow chart illustrating the fabrication method of discharge lamps according to the present invention.

FIG. 5 is a flow chart for the fabrication method of discharge lamps according to an embodiment of the present invention, illustrated with reference to the discharge lamp 20 shown in FIG. 2. First, in step 500, a glass tube 200 (of diameter between 2 and 20 mm) with fluorescent phosphor on the inner wall thereof is provided, preferably a through, randomly shaped glass tube. For example, this glass tube 202 may be straight, curved or helical but not limited to those shapes.

In step 502, a pair of hollow and/or ring-shaped dielectric electrodes are provided, such as the dielectric electrodes 208*a* and 208*b* (about 10 mm to 20 mm in depth). In other embodiments, as shown in FIG. 4, a pair of through, randomly shaped dielectric electrodes 408*a* and 408*b* may be selected. The dielectric electrodes 208*a*, 208*b* are respectively connected to the both ends of the glass tube 202. The dielectric electrodes 208*a*, 208*b* selected have a diameter slightly large than that of the glass tube 202, such that the inner wall of the dielectric electrodes 208*a*, 208*b* wrap the outer wall of the glass tube 202 while forming a connection there between. Nonetheless, depending on design considerations, the dielectric electrodes 208*a*, 208*b* and the glass tube 202 may be connected in an opposite manner, specifically, the glass tube 202 having a larger diameter and the inner wall thereof wrapping the outer wall of the dielectric electrodes 208*a* and 208*b*. Furthermore, the depth of contacted portion D1 of the glass tube 202 and the dielectric electrodes 208*a* and 208*b* is typically set to be 1.5 to 5 mm.

In step 504, an adhesive is applied to the contacted portion D1 of the glass tube and the dielectric electrodes to fix both together.

In step 506, two glass tubes 210*a* and 210*b* (about 2-5 mm in length, preferably shorter where possible), each having two ends forming through passage, are connected to the dielectric electrodes 208*a* and 208*b* in the manner as described in step 502, such that these two glass tubes 210 are connected to the other ends (one not connected to the glass tube 202) of the dielectric electrodes 208*a* and 208*b*. Similarly, the depth of the contacted portions D2 of the glass tube 210*a* and the dielectric electrode 208*a*, and of the glass tube 210*b* and the dielectric electrode 208*b*, is set to be 1.5 to 5 mm, which results in a practical active depth of about 5-15 mm for the dielectric electrodes 208*a* and 208*b*. In an alternative embodiment, as shown in FIG. 3, only one glass tube 310 may be used to connect to one of the dielectric electrodes 308*a* and 308*b*. However, in this case, instead of being a hollow ring shape, the dielectric electrode 308*a* not connected to the glass tube 310 is cup-shaped with an opening creating a sealing effect on the linkage from the glass tube 302 thereto.

In step 508, same as in step 504, an adhesive is applied to the respective contacted portions of the glass tubes 210*a*, 210*b* and the dielectric electrodes 208*a* and 208*b*. It should be understood that steps 502 to 508 need not to be executed in a particular order but based on actual process requirements.

In steps 504 and 508, the adhesive used may be glass glue which may include glass power, binder resin and organic solvent, and may further be distinguished as Lead (Pb)-based glass paste and Lead (Pb)-free glass paste based on whether lead is added.

For example, in Lead (Pb)-based glass paste, the glass power may be a lead containing compound such as $PbO—B_2O_3—SiO_2$, $PbO—B_2O_3—SiO_2—Al_2O_3$, $ZnO—B_2O_3—SiO_2$ or $PbO—ZnO—B_2O_3—SiO_2$, etc; binder resin may be acrylic resin such as methyl (meth)acrylate, isopropyl (meth) acrylate, butyl methacrylate or 2-hydroxypropyl methacrylate, or the combination thereof; organic solvent may be ketones, alcohols, ether-based alcohols, lactates, ether-based Ether, Propylene glycol monomethyl ether or Butyl-di-glycol-acetate, or the combination thereof.

On the other hand, in Lead (Pb)-free glass paste, glass power may be $P_2O_5—SnO—B_2O_3$, $P_2O_5—SnO—Bi_2O_3$ or $Bi_2O_3—ZnO—B_2O_3—Al_2O_3—SiO_2$ ($CeO_2$+CuO+$Fe_2O_3$); binder resin may be polyurethane resin; organic solvent may be dimethyl formamide, methanol, xylene, butyl acetate, isopropanol or Butyl-di-glycol-acetate, or the combination thereof.

In step 510, the above-mentioned glass tube 202, dielectric electrodes 208*a*, 208*b* and glass tubes 210*a*, 210*b* are connected to form a lamp structure, and after the contacted portions of these components are applied with adhesive, the sintering process commences. The flow of the sintering process includes: disposing the lamp structure into a sintering device to let the adhesive solidify, thereby making the contacted portions of the lamp structure components firmly engage. Preferably, this sintering process may be a roasting process having a three-stage heating scheme. For example, in the first stage, the temperature of the sintering device is raised to 150° C.~170° C. at a rate of 5° C.~10° C. per minute, and continuously heats up for 10 to 60 minutes. Next, in the second stage, the temperature is raised again to 500° C.~700° C. where heating is applied for 5 to 50 minutes. Finally, in the third stage, the temperature is lowered to 150° C.~500° C. at a rate of 5° C.~10° C. per minute and heating is applied for 20 to 120 minutes. In an alternative embodiment, the sintering process described above is carried out in a single-stage heating scheme in which heating is applied for 30 to 120 minutes at a temperature of 150° C.~700° C.

In another embodiment, steps 504 and 508 may be omitted to selectively not apply any adhesive. In such case, direct fire is used to heat up the junctions of the dielectric electrodes 208*a*, 208*b* and glass tubes 202, 210*a*, 210*b* until melted to combine the electrodes 208*a*, 208*b* and glass tubes 202, 210*a*, 210*b* together. For example, one to eight direct fires may be used to directly heat up the junctions of the glass tube and the dielectric electrode, as described in the following three manufacture process conditions but not limited to those. First, only one fire with temperature around 1000° C. to 1900° C. is used to heat up continuously for 5 to 60 seconds. Second, five fires with temperature around 1000° C. to 1900° C. are consecutively used to heat up continuously for 3 to 30 seconds. Third, eight fires with temperature also around 1000° C. to 1900° C. are consecutively used to heat up continuously for 3 to 30 seconds. It should be noted that heating temperature and duration are different due to different materials of the dielectric electrodes and glass tubes in the above three conditions.

What can be inferred from the above description is that the difference on whether an adhesive is used may depend on what sintering processes (including temperature and duration) will be selected in the subsequent sintering step.

In step 512, after the sintering step is performed, a filling process is applied to the lamp structure. This filling process includes filling in the mixed gas 204 at the sealing pressure of 1 to 300 torr and adding solid mercury (or liquid mercury) into the lamp structure, wherein the mixed gas contains 90% of argon and 10% of neon. In other embodiments, the above mixed gas may be selected from a group of inert gases consisting of 10% to 90% of argon, 10% to 90% of neon, 10% to 90% of krypton, 5% to 50% of nitrogen, and 1% to 90% of xenon. Furthermore, in another embodiment, the filling process includes filling in the mixed gas 204 at the sealing pressure of 2 to 180 torr, with the addition of xenon instead of mercury 206 into the above lamp structure.

Finally, in step 514, the both ends of the two glass tubes 210*a* and 210*b* are sealed. Generally, flame of adequate temperature may be used to seal the respective ends of the glass tube connected to the dielectric electrodes 208*a* and 208*b* in this sealing process, to complete the fabrication of the discharge lamp 20.

Although the specific embodiments of the present invention have been illustrated and described, it is to be understood that the invention is not limited to those embodiments. One skilled in the art may make various modifications without departing from the scope or spirit of the invention.

The invention claimed is:

1. A fabrication method of discharge lamps, comprising:

(a) providing a glass tube of diameter between 2 and 20 mm, said glass tube having an inner wall coated with a fluorescent phosphor and having a through-passage with a first end and a second end;

(b) connecting a first dielectric electrode to said first end of said glass tube by applying an adhesive to a contacted portion of said glass tube and said first dielectric electrode; and (c) sintering said contacted portion of said glass tube and said first dielectric electrode to securely connect said glass tube with said first dielectric electrode.

2. The method of claim 1, wherein said adhesive comprises a glass glue.

3. The method of claim 1, wherein said first dielectric electrode is formed of a ceramic material.

4. The method of claim 3, wherein said ceramic material has a dielectric constant of about 10 or above.

5. The method of claim 1, wherein said first dielectric electrode comprises a glass frit including $K_2O$, $Na_2O$, $B_2O_3$, $SiO_2$, $Al_2O_3$, or a combination thereof.

6. The method of claim 1, wherein an outer surface of said first dielectric electrode is coated with a conductive layer.

7. The method of claim 1, wherein in said contact portion, an outer wall of said glass tube is wrapped against an inner wall of said first dielectric electrode.

8. The method of claim 1, wherein in said contact portion, an outer wall of said first dielectric electrode is wrapped against said inner wall of said glass tube.

9. The method of claim 1, wherein said first dielectric electrode is hollow-shaped with a first opening on one end of said first dielectric electrode and a second opening on the other end of said first dielectric electrode.

10. The method of claim 9, wherein said first opening and said second opening are different in size.

11. The method of claim 9, wherein said first dielectric electrode is ring-shaped.

12. The method of claim 11, wherein said first dielectric electrode has a midsection having a smaller diameter than diameters of said first opening and said second opening.

13. The method of claim 9, wherein said step (b) comprises connecting said first opening of said first dielectric electrode to said first end of said glass tube, and further comprises connecting said second opening of said first dielectric electrode to a first glass tube by applying said adhesive to a first contacted portion of said first glass tube and said first dielectric electrode.

14. The method of claim 13, wherein said step (c) further comprises sintering said first contacted portion of said first glass tube and said first dielectric electrode to securely connect said first glass tube with said first dielectric electrode.

15. The method of claim 1, wherein said first dielectric electrode is cup-shaped with an opening on one end thereof, and said opening of said first dielectric electrode is connected to said first end of said glass tube.

16. The method of claim 1, wherein said step (b) further comprises connecting a second dielectric electrode to said second end of said glass tube by applying said adhesive to a second contacted portion of said glass tube and said second dielectric electrode, and said step (c) further comprises sintering said second contacted portion of said glass tube and said second dielectric electrode to securely connect said glass tube with said second dielectric electrode.

17. The method of claim 16, wherein said first dielectric electrode and said second dielectric electrode are different in shape.

18. The method of claim 1, wherein said glass tube is straight.

19. The method of claim 1, wherein said glass tube has at least a curved part.

20. The method of claim 1, further comprising a filling process and a sealing process after said step (c).

* * * * *